US008374857B2

(12) United States Patent
Kurniawati et al.

(10) Patent No.: US 8,374,857 B2
(45) Date of Patent: Feb. 12, 2013

(54) ESTIMATING RATE CONTROLLING PARAMETERS IN PERCEPTUAL AUDIO ENCODERS

(75) Inventors: Evelyn Kurniawati, Singapore (SG); Kim Hann Kuah, Singapore (SG); Sapna George, Singapore (SG)

(73) Assignee: STMicroelectronics Asia Pacific Pte, Ltd., Singapore (SG)

( * ) Notice: Subject to any disclaimer, the term of this patent is extended or adjusted under 35 U.S.C. 154(b) by 1006 days.

(21) Appl. No.: 11/890,275

(22) Filed: Aug. 3, 2007

(65) Prior Publication Data

US 2008/0040120 A1 Feb. 14, 2008

Related U.S. Application Data

(60) Provisional application No. 60/836,163, filed on Aug. 8, 2006.

(51) Int. Cl.
*G10L 19/02* (2006.01)

(52) U.S. Cl. ..... 704/229; 704/230; 704/500; 704/501; 704/502; 704/504

(58) Field of Classification Search ..... 704/229, 704/230, 500–504
See application file for complete search history.

(56) References Cited

U.S. PATENT DOCUMENTS

| | | | | |
|---|---|---|---|---|
| 7,197,289 | B2 * | 3/2007 | Zeira et al. | 455/234.1 |
| 2003/0031341 | A1 * | 2/2003 | Rhoads | 382/100 |
| 2003/0083867 | A1 * | 5/2003 | Lopez-Estrada et al. | 704/219 |
| 2004/0162723 | A1 * | 8/2004 | Lopez-Estrada et al. | 704/230 |
| 2004/0176054 | A1 * | 9/2004 | Zeira et al. | 455/127.2 |

FOREIGN PATENT DOCUMENTS

EP 1 850 327 A1 10/2007

OTHER PUBLICATIONS

Chun-Yi Lee et al., "A Fast Audio Bit Allocation Technique Based on a Linear R-D Model," IEEE Transactions on Consumer Electronics, vol. 48, No. 3, Aug. 2002, pp. 662-670.
E. Kurniawati et al., "New Implementation Techniques of an Efficient MPEG Advanced Audio Coder," 2004 IEEE, vol. 50, pp. 655-665.
Jurgen Herre, "Temporal Noise Shaping, Quantization and Coding Methods In Perceptual Audio Coding: A Tutorial Introduction," AES 17th International Conference on High Quality Audio Coding, Sep. 2, 1999, pp. 1-14.
European Search Report completed Nov. 13, 2007 in European Patent Application No. EP 07 25 3111.

* cited by examiner

*Primary Examiner* — Leonard Saint Cyr
(74) *Attorney, Agent, or Firm* — Munck Wilson Mandala, LLP

(57) ABSTRACT

Perceptual audio coder refers to audio compression schemes that exploit the properties of human auditory perception. The coder allocates the quantization noise below the masking threshold such that even with the bit rate limitation, the noise is imperceptible to the ear. These distortion and bit rate requirement makes the bit allocation-quantization process a considerable computational effort. One method includes incrementally adjusting a global gain according to a gradient. The gradient could be adjusted each time the number of bits used to represent a quantized value is counted. Another method includes limiting a rate controlling parameter to a predetermined number of loops. The method could also include deriving a global gain to ensure exit from the loop. Accordingly, embodiments of the present disclosure provide a fast and efficient method to derive the rate controlling parameter and can be applied to generic perceptual audio encoders where low computational complexity is required.

23 Claims, 4 Drawing Sheets

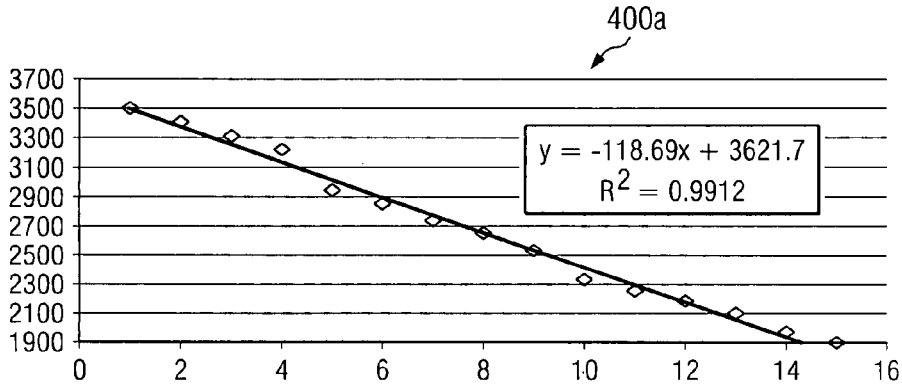
*FIG. 4A*
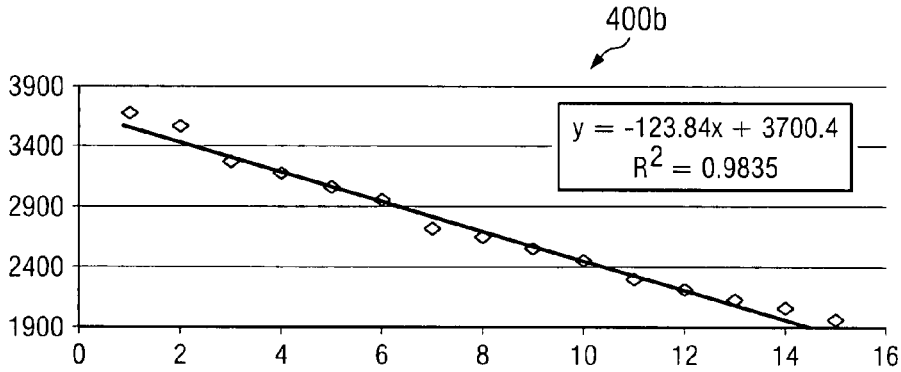
*FIG. 4B*
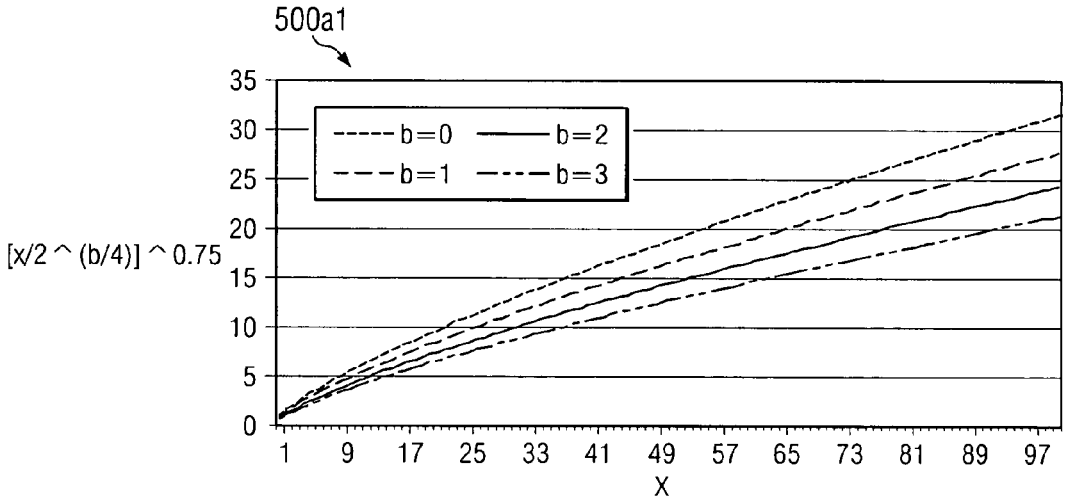
*FIG. 5A1*

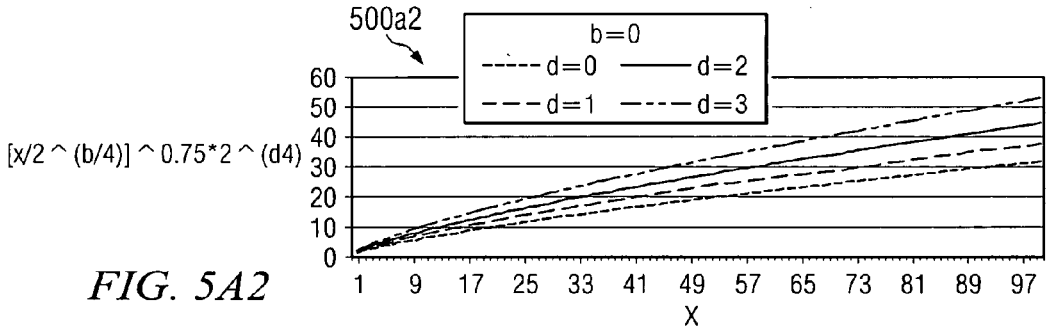
FIG. 5A2
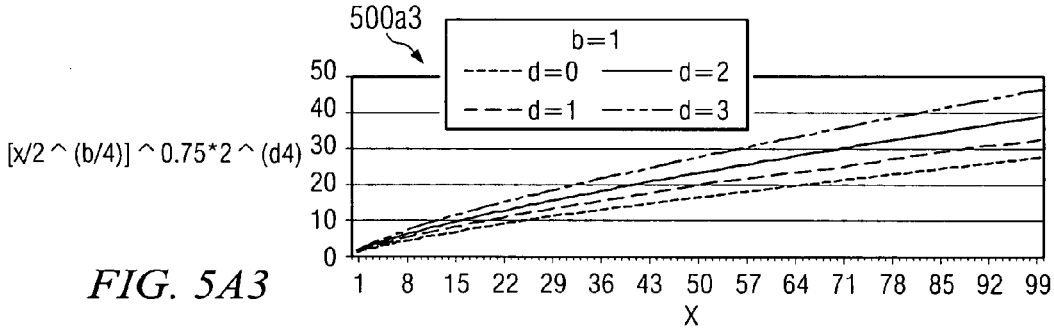
FIG. 5A3
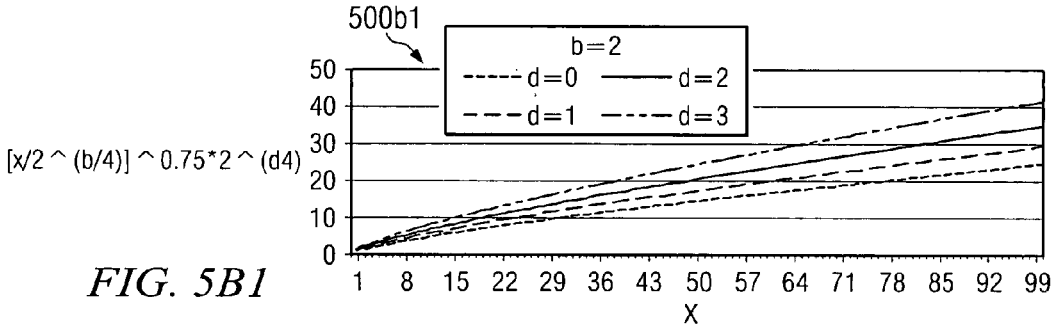
FIG. 5B1
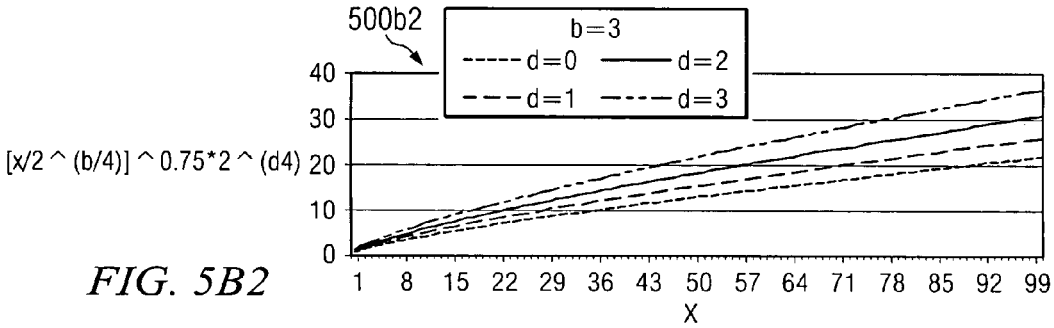
FIG. 5B2

ESTIMATING RATE CONTROLLING PARAMETERS IN PERCEPTUAL AUDIO ENCODERS

CROSS-REFERENCE TO RELATED APPLICATION AND CLAIM OF PRIORITY

The present application is related to U.S. Provisional Patent No. 60/836,163, filed Aug. 8, 2006, entitled "FAST AND EFFICIENT METHOD TO ESTIMATE THE RATE CONTROLLING PARAMETER IN A PERCEPTUAL AUDIO ENCODER". U.S. Provisional Patent No. 60/836,163 is assigned to the assignee of the present application and is hereby incorporated by reference into the present disclosure as if fully set forth herein. The present application hereby claims priority under 35 U.S.C. §119(e) to U.S. Provisional Patent No. 60/836,163.

TECHNICAL FIELD

The present disclosure relates generally to the field of audio compression for transmission or storage purposes, and more particularly to those systems having low power devices.

BACKGROUND

Digital audio transmission requires a considerable amount of memory and bandwidth. To achieve an efficient transmission, signal compression techniques need to be employed that optimally eliminate irrelevant and redundant parts of an audio stream.

Perceptual audio coders generally use compression schemes to exploit the properties of human auditory perception. Such coders also require eliminating irrelevant and redundant parts of the associated audio stream.

There is therefore a need for systems and methods for estimating rate controlling parameters in perceptual audio encoders.

SUMMARY

The present disclosure generally provides systems and methods for estimating rate controlling parameters in perceptual audio encoders In one embodiment, the present disclosure provides a method of bit allocation for use in an audio encoder. The method includes incrementally adjusting a global gain according to a gradient. The gradient could be adjusted each time the number of bits used to represent a quantized value is counted.

In another embodiment, the present disclosure provides a method of bit allocation for use in a perceptual audio coder: The method includes incrementally adjusting a global gain according to a gradient. The method also includes adjusting the gradient according to the number of bits used to represent a quantized value. The method could further include limiting a rate controlling parameter of the audio coder to a predetermined number of loops.

In still another embodiment, the present disclosure provides a method of bit allocation. The method includes limiting a rate controlling parameter to a predetermined number of loops. The method could also include deriving a global gain to ensure exit from the loop.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which:

FIGS. 4A and 4B illustrate a correlation between global gain change and the number of bits used according to one embodiment of the present disclosure;

FIG. 5A illustrates the first term values of the quantization equation for varying b (Equation 3) according to one embodiment of the present disclosure;

FIG. 5B illustrates the first term values after the scaling by four possible factors depending on d (Equation 3) according to one embodiment of the present disclosure;

DETAILED DESCRIPTION

Figure 1:
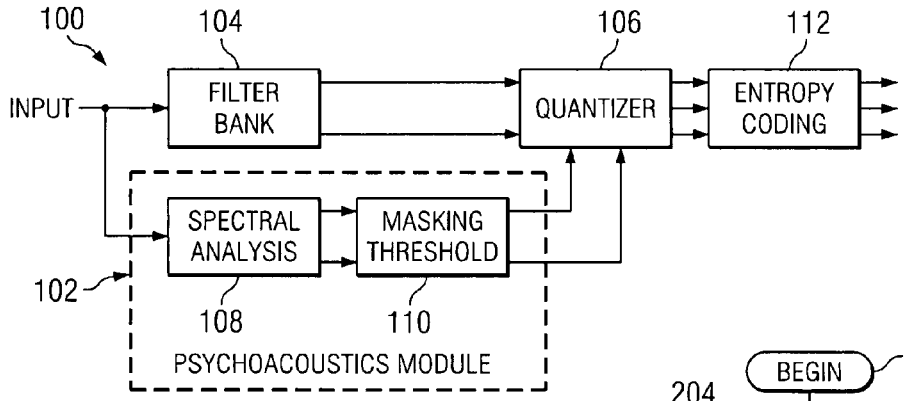
FIG. 1 is a somewhat simplified block diagram illustrating a perceptual audio coder according to one embodiment of the present disclosure.

FIG. 1 is a somewhat simplified block diagram illustrating the general structure of a perceptual encoder 100. The embodiment of perceptual encoder 100 shown in FIG. 1 is for illustration only. Other embodiments of perceptual encoder 100 may be used without departing from the scope of this disclosure.

Perceptual encoder 100 generally includes an input coupled to psychoacoustics module (PAM) 102 and filter bank 104. Filter bank 104 is, in turn, coupled to bit allocation and quantization module 106. In one embodiment, psychoacoustics module 102 could include spectral analysis and processing module 108 and masking/threshold module 110. Although psychoacoustics module 102 is shown with two internal processing modules, spectral analysis and processing module 108 and masking/threshold module 110, it should be understood that other suitable processing modules could be used in conjunction with and/or in lieu of spectral analysis and processing module 108 and masking/threshold module 110.

Psychoacoustics module 102, more specifically masking/threshold module 110, could be coupled to bit allocation and quantization module 106. Psychoacoustics module 102 is generally used to reduce redundant components. Psychoacoustics module 102 could make use of certain prediction tools, for example in one or both of spectral analysis and processing module 108 and masking/threshold module 110.

Filter bank 104 is generally responsible for time to frequency transformation. Filter bank 104 could include any number of filters, adjustable filters or any suitable combination thereof. The transformation to frequency domain is generally inevitable to make use of masking properties in human ears. The window size and transform size of filter bank 104 generally determines, for example, the time and frequency resolution, respectively.

In one embodiment, psychoacoustics module 102, together with spectral analysis and processing module 108 and masking/threshold module 110, determine the masking threshold. The masking threshold is generally required to judge the parts of the signal important to human perception and which parts of the signal are irrelevant. The resulting masking threshold from psychoacoustics module 102 could also be used to shape the quantization noise so that, for example, no degradation is perceived due to the quantization process.

The respective outputs of psychoacoustics module 102 and filter bank 104 are coupled to bit allocation and quantization module 106. As shown in FIG. 1, the output of bit allocation and quantization module 106 is then coupled to entropy coding or compression module 112.

Bit allocation and quantization module 106, is a crucial module in perceptual audio encoder 100 and could include, for example, a non-uniform quantizer. Bit allocation and quantization module 106 could be used to: (1) reduce the dynamic range of the data; and (2) adjust two quantization parameters for step size determination such that the quantization noise falls below the masking threshold. In other words, bit allocation and quantization module 106 could include a "distortion control loop".

Bit allocation and quantization module 106 could also ensure that the number of bits used is below the available bit rate. In other words, bit allocation and quantization module 106 could include a "rate control loop".

Bit allocation and quantization module 106 could further include incorporating noiseless coding for redundancy reduction to enhance the compression ratio. Accordingly, the presence of psychoacoustics module 102 and the bit allocation and quantization module 106 in perceptual encoder 100 generally increase the complexity of such encoders when compared to a typical decoder.

It should be understood that audio encoding standards are generally ensure that a valid stream is correctly decodable by the decoders. The standards, however, are flexible enough to accommodate variations in implementations and are suited to different resources available and application areas.

Figure 2:
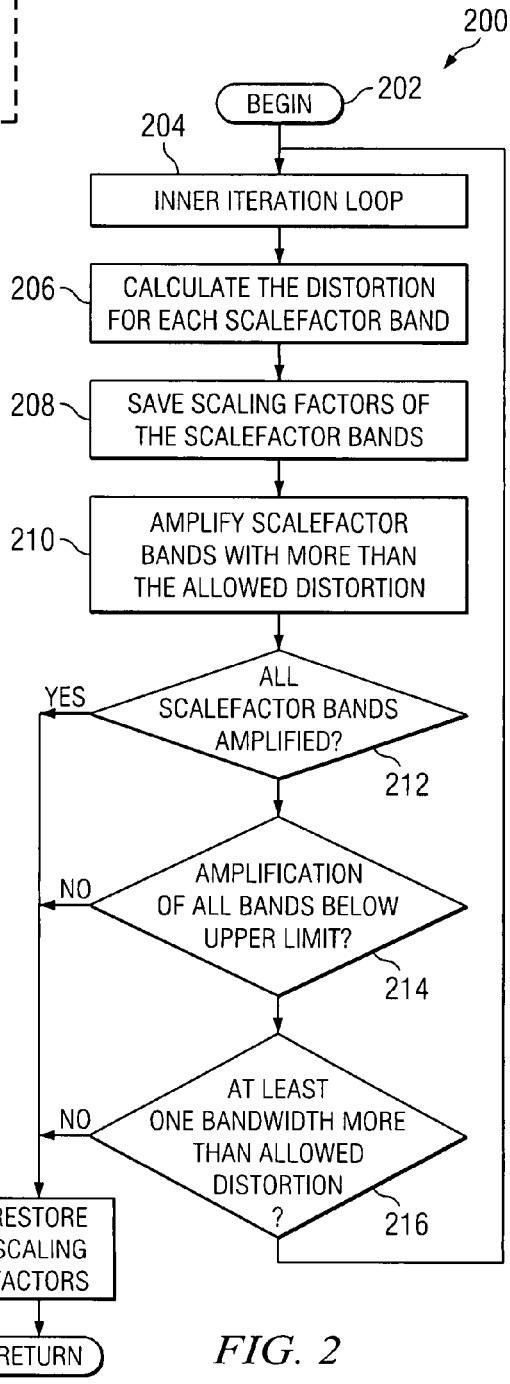
FIG. 2 is a somewhat simplified flow diagram illustrating an outer iteration loop in a perceptual audio encoder according to one embodiment of the present disclosure.

FIG. 2 generally depicts method 200 for controlling distortion and the rate control loop. The embodiment of method 200 shown in FIG. 2 is for illustration only. Other embodiments of method 200 may be used without departing from the scope of this disclosure.

Beginning with step 202, method 200 generally includes performing an inner iteration loop at step 204. One embodiment of the "inner iteration loop" performed at step 204 is described in detail in conjunction with FIG. 3 herein.

In step 206, method 200 continues by calculating the distortion for each scalefactor band. In step 208, method 200 saves the scaling factors of the scalefactor bands and then amplifies those scalefactor bands with more than the allowed distortion in step 210.

Method 200 continues with step 212 by comparing whether all of the scalefactor bands have been amplified. If not, method 200 continues and verifies whether amplification of all bands below a predetermined upper limit has been performed in step 214. If yes, then method 200 continues with step 216 and verifies whether there is at least one band with more than the allowed distortion. If so, then method 200 continues by returning to step 204 thereby establishing an "outer loop iteration".

If in step 212, all of the scalefactor bands have been amplified, method 200 continues with step 218. Similarly, if in step 214, the amplification of all bands below an upper limit is complete, then method 200 continues with step 218. Likewise, if in step 216, if there are no bands with more than the allowed distortion, then method 200 continues with step 218. At step 218, method 200 restores the scaling factors and ends at step 220. At step 220, method 200 could end or return to step 204.

In one embodiment, method 200 therefore generally provides an "outer iteration loop" having an "inner iteration loop" at step 204 for controlling distortion and the rate control loop in a perceptual audio encoder.

Figure 3:
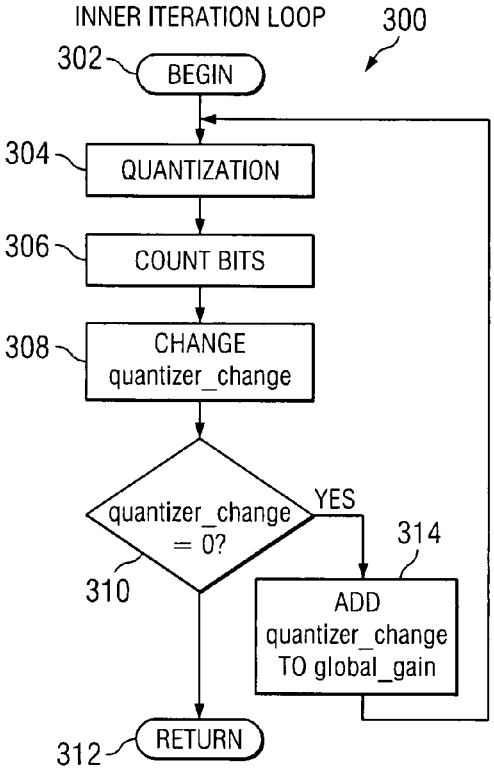
FIG. 3 is a somewhat simplified flow diagram illustrating an inner iteration loop in a perceptual audio encoder according to one embodiment of the present disclosure.

FIG. 3 generally depicts method 300 for performing an inner iteration loop such as, for example, inner iteration loop 204 shown in FIG. 2. The embodiment of method 300 shown in FIG. 3 is for illustration only. Other embodiments of method 300 may be used without departing from the scope of this disclosure.

Method 300 begins with step 302. In step 304, quantization occurs. In step 306, method 300 counts the bits. To satisfy both requirements, a nested loop formation is used with the same rate control as the inner iteration loop 204. The 'count bits' process takes in quantized spectrum as input in step 306.

The parameter "quantizer_change" could be changed accordingly in step 308. In step 310, method 300 ascertains whether the parameter "quantizer_change" is equal to zero. If not, method 300 ends in step 312. If the parameter "quantizer_change" is equal to zero, then method 300 continues in step 314 where "quantizer_change" is added to the parameter "global_gain".

Thus, the quantization process in method 300 could be repeated every time inner iteration loop 204 is called upon. Furthermore, in one embodiment, the 'count bits' may also include a noiseless coding tool, in which the complexity of this inner loop is increased.

Generally, there are two main issues to address when optimizing the bit allocation loop. The first issue is the calculation of the non-uniformly quantized spectrum. The calculation of the non-uniform quantized spectrum could be accomplished using any one or combinations of different methods including, for example, using a lookup table combined with an interpolation scheme.

The second issue is the derivation of the quantization parameters. The quantization parameters could include, for example, the global scale factor (the rate controlling parameter) and the scale factors (the distortion controlling parameter). In one embodiment, Trellis-based optimization methods could derive scale factors and to optimize the Huffman Codebook selection. To reduce the number of iterations, one embodiment of the present disclosure could use the previous frame quantization parameters as a reference or starting point.

In one embodiment, the present disclosure provides an alternative low-power implementation of the inner iteration loop 204 or method 300 for bit allocation and quantization module 106 in perceptual encoder 100.

Since only inner iteration loop 204 or method 300 are discussed here, the relevant parameter involved is the global scale factor. A typical non-uniform quantizer used in perceptual coder 100 is shown by the relationship found in Equation 1 below.

$$\text{x_quantized}(i, k) = \text{int}\left[\frac{x(i, k)^{3/4}}{2^{\frac{3}{16}(gl-scf(i))}} + C\right] \quad \text{(Eqn. 1)}$$

In Equation 1, i is the scale factor band index, x are the spectral values within that band to be quantized, k is the spectral index, C is a constant, gl is the global scale factor, and scf(i) is the scale factor value.

The calculation in Equation 1 is performed to each of the spectral lines every time the inner iteration loop 204 or method 300 is called upon. Moreover, whenever there is adjustment in the quantization step size (determined by the gl and scf(i)), this calculation is repeated. One embodiment of the present disclosure generally provides a method to simplify this calculation.

Apart from the quantization, the number of times the inner iteration loop 204 or method 300 is called upon generally affects the computational complexity of the encoder 100. For example, if the inner iteration loop 204 is called upon a relatively high number of times, the computational complexity of the encoder 100 could relatively increase. Accordingly, in one embodiment, the present disclosure generally provides a system and method to reduce the number of times the inner iteration loop 204 or method 300 is performed.

The "outer loop" or the distortion loop has a relatively less stringent exit criterion than the "inner loop" (i.e., inner iteration loop 204 or method 300) or rate control loop. Ideally, the outer loop should ensure that the distortion is below the masking threshold. However, due to time or resource limitation, the outer loop could be exited with some decrease in quality. The decrease in quality could then be remedied by allocating the distortion in an insignificant band.

The inner iteration loop 204 or method 300, on the other hand, safe guards the bit rate of the encoded streams. It is generally not possible to exit inner iteration loop 204 or method 300 because most bit rates or compression ratios are guaranteed by the encoding scheme. In other words, the global gain value has to satisfy the bit rate requirement regardless of the number of loops required.

The relationship between global gain and the number of bits used is complicated by the presence of the noiseless coding. In one embodiment, the present disclosure generally provides a method to derive the global gain to satisfy the bit rate requirement. Moreover, in the event of scarce computing resources, this method could be carried out while providing an exit from the inner iteration loop 204 or method 300.

Accordingly, embodiments of the present disclosure generally show that with careful selection of the adjustment value of the global gain, the computational complexity of the quantization can be reduced. The number of iterations in inner iteration loop 204 or method 300 could also be reduced by using gradient based adjustment instead of incremental adjustments. This gradient is adjusted every time the number of bits used is counted (see e.g., step 306 to 'count bits' in FIG. 3). For simplicity, linear relations within one frame are assumed between the number of bits used and the global scale factor value.

Lastly, in one embodiment, the present disclosure provides a bail out method by deriving the value of global scale factor that ensures the number of bits used is below the target bit rate. This could be done by assuming a worse-case use of the Huffman codebook in the noiseless coding process.

Gradient Based Adjustment Method

In one embodiment, inner iteration loop 204 or method 300 could be implemented in a bit allocation module such as, for example, bit allocation and quantization module 106 by changing the quantizer step size. For example, in step 314 of method 300 described above, the quantizer_change could be changed to the global_gain.

There are several methods for finding the global gain in accordance with embodiments of the present disclosure. The first example method generally incrementally increases the value of the variable. This method generally works best when the target value is not far from the initial value. The second example method generally uses binary searches. Binary searches guarantee optimum values after 'n' number of tries, where 'n' is the number of bits used to represent the global gain.

In one embodiment, the present disclosure preferably uses incremental increases only after the first try. After the relationship between the quantizer change and the bit used is established, the adjustment is performed with linear assumption of this relation.

FIGS. 4A and 4B generally show plots 400*a* and 400*b* illustrating the linear relationship with a high degree of correlation between the global gain change and the number of bits used according to one embodiment of the present disclosure. Plots 400*a* and 400*b* are for illustration only. Other embodiments of Plots 400*a* and 400*b* may be apparent without departing from the scope of this disclosure.

If the second trial fails, the adjustment could be performed again after the gradient relating the two variables is adjusted based on results of the previous tries.

Quantizer Step Size Change Method

A typical quantization formula is shown by, for example, the relationship shown in Equation 1 above. Without using the scale factor band index and the spectral index, a more general form of Equation 1 is shown in the relationship given by Equation 2A below.

$$\text{x_quantized} = \text{int}\left[\left(\frac{x}{2^{\frac{\Delta}{4}}}\right)^{3/4} + C\right] \quad \text{(Eqn. 2A)}$$

In Equation 2A, Δ represents the quantization step size from the expression (gl−scf(i)). Importantly, the main crux of the computation is in calculating $$\left(\frac{x}{2^{\frac{\Delta}{4}}}\right)^{3/4}.$$

$$\text{If } \frac{\Delta}{4} = a + \frac{b}{4},$$

where b<4, Equation 2A above generally becomes Equation 2B below.

$$Xq = \left(\frac{x}{2^{\frac{b}{4}}}\right)^{3/4} \cdot 2^{-\frac{3a}{4}} \quad \text{(Eqn. 2B)}$$

$$\text{If } -3 \cdot a = c + \frac{d}{4},$$

where d<4, Equation 2B becomes Equation 3 below.

$$Xq = \left(\frac{x}{2^{\frac{b}{4}}}\right)^{3/4} \cdot 2^{c} \cdot 2^{\frac{d}{4}} \quad \text{(Eqn. 3)}$$

In one embodiment, the calculation of the first term to the power of ¾ could use a lookup table. The size of the lookup table depends on the accuracy desired. The next two terms are basically a shift by c and a multiplication by $2^{d/4}$ Since d<4 and b<4, there are only four possible value for these terms which can conveniently be stored in a table. With this method, the power calculation is reduced into two main multiplications and a shift according to one embodiment of the present disclosure.

As mentioned earlier, the first adjustment of the step size Δ is incremental. Afterwards, the gradient and the target bit used will determine how much increase is to be added. Any change in Δ would affect the variable b, c, and d in Equation 3. In this case, the quantized value may be 'fully' recalculated. However, if the change of Δ is divisible by four, there will be no change in variable b, hence one multiplication computation need not be performed. Based on this, in one embodiment, the present disclosure uses only modification by a multiple of four for the gradient-based adjustments.

FIGS. 5A1, 5A2 and 5A3 generally illustrates plots 500*a*1, 500*a*2 and 500*a*3, respectively, where the values of the first term in Equation 3 for four possible values of b according to one embodiment of the present disclosure. In other words, FIGS. 5A1, 5A2 and 5A3 show the first term values of the quantization equation for varying b in Equation 3. Plots 500*a*1, 500*a*2 and 500*a*3 are for illustration only. Other embodiments of plots 500*a*1, 500*a*2 and 500*a*3 may be apparent without departing from the scope of this disclosure.

The value of b used will follow the incremental adjustment described earlier and after which the first term will be kept constant. Scaling of the first term is performed during further adjustments. With this method, Xq can be obtained from just one multiplication and a shift.

In one embodiment, the present disclosure provides a method for approximating Xq directly and uses stored values and a simple shift. This is done by introducing tables for the scaling by $2^{d/4}$ Since there are only 4 possible values for this term, a simple mapping may be done based on the value of d.

FIGS. 5B1 and 5B2 generally illustrate plots 500*b*1 and 500*b*2, respectively, showing the results for the four possible values of d. In other words, FIGS. 5B1 and 5B2 show the first term values after the scaling by four possible factors depending on d from Equation 3. Plots 500*b*1 and 500*b*2 are for illustration only. Other embodiments of plots 500*b*1 and 500*b*2 may be apparent without departing from the scope of this disclosure.

After the incremental adjustment, the first term is kept constant. Based on this value, a table look up is performed depending on the value of d used. In one embodiment, the only operation needed is to shift the obtained value by c. The size of the table used to map the first term to its scaled value is application dependent. If additional accuracy is desired, interpolation can be adopted to reduce any rounding errors during the table look up process.

Bail Out Method

Despite the effort to promptly converge to an acceptable value of a quantization parameter (global gain in this case), it is not generally possible to analyze how many iterations are needed to arrive at the desired value. This characteristic is undesirable, especially for low power encoders, where it is important that the absolute worse case does not exceed the available computing resources.

To limit the number of quantization iterations, a bail out method is introduced once the number of iterations has reached the designated limit. This method, however, will introduce unnecessary quantization noise for all scale factor bands (since global scale factor is applied to all scale factor bands). It is important to set the proper maximum limit for the number of iterations. Excessive application of this bail out method may lead to quality degradation.

Encoders need to have exact predictions for the number of bits used based on the global gain in the presence of Huffman coding. Each scale factor band may choose its own Huffman codebook, and the number of bits used is dependent on both its quantized spectral values and its codebook choice.

In one embodiment, the codebook is normally chosen based on the LAV (largest absolute value) of the spectral coefficients, since each codebook has a limit in the LAV which they can represent. Based on this, it is possible to derive the worse case number of bits used, provided that the LAV of that scale factor band is known.

In normal flow, the quantized spectrum is generally obtained first then the Huffman codebook (for each band) is chosen based on its LAV. Lastly, the actual coding is performed based on the number of bits known. According to one embodiment, the present disclosure works the other way around. In other words, because the number of bits used (the bit budget) is known, it is possible to derive the LAV (assuming the worse case codebook is used). This will satisfy the bit budget criteria. Once the LAV is known keep, the scheme would derive the quantization parameter based Equation 4 below.

$$\Delta = \frac{16}{3}\log_2\left(\frac{\max_x^{3/4}}{\text{desired_LAV}}\right) \quad \text{(Eqn. 4)}$$

The global gain value is then obtained from the parameter Δ.

Embodiments of the present disclosure may be applied to any suitable perceptual encoder. For example, embodiments of the present disclosure could be applicable to perceptual encoders that use a non-linear quantization of the type INT ($x^{M/N}$+constant). For example, applications such as MPEG-1 and MPEG-2 layer III (MP3) and MPEG Advanced Audio Coding (AAC) may use non-linear quantization. The following describes embodiments of the present disclosure in the context of an MP3 encoder application.

Filterbank

Figure 6:
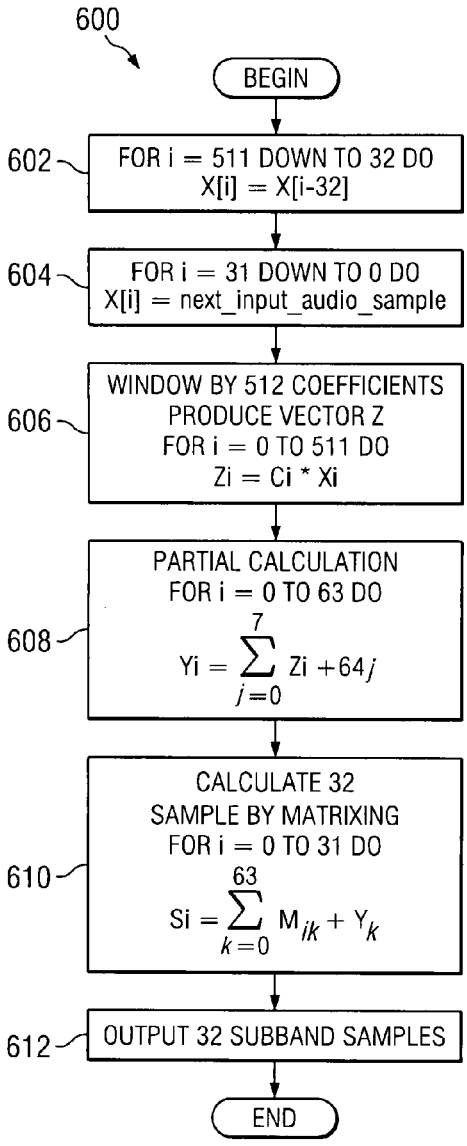
FIG. 6 is a somewhat simplified flow diagram showing a method of MP3 subband filter analysis according to one embodiment of the present disclosure.

FIG. 6 generally illustrates method 600 where subband filterbanks are used to split the broadband signal into 32 equally spaced subbands. MP3 applications use hybrid filters including a subband filterbank and an MDCT filterbank. The embodiment of method 600 shown in FIG. 6 is for illustration only. Other embodiments of method 600 could be used without departing from the scope of this disclosure.

In one embodiment, the MDCT used is formulated as shown by Equation 5 below.

$$X_i = \sum_{k=0}^{n-1} z_k \cos\left(\frac{\pi}{2n}\left(2k+1+\frac{n}{2}\right)(2i+1)\right),\ i = 0 to \frac{n}{2}-1 \quad \text{(Eqn. 5)}$$

In Equation 5, z is the windowed input sequence, k is the sample index, i is the spectral coefficient index, and n is the window length (12 for short block and 36 for long block). The size is determined by the transient detect module.

Psychoacoustics Model (PAM)

Figure 7:
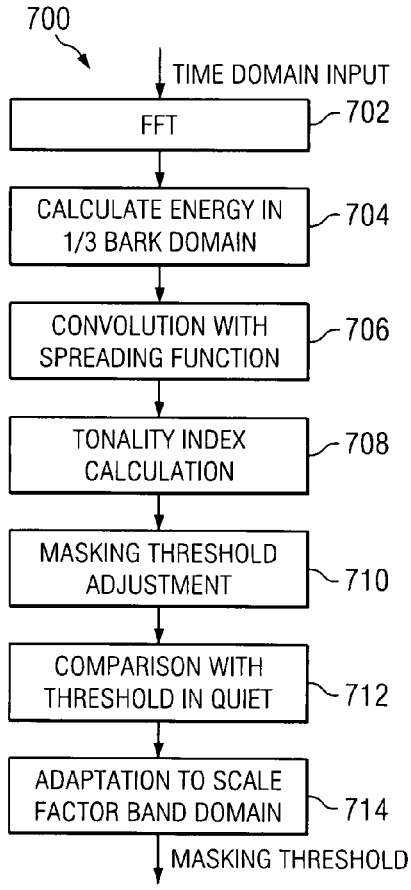
FIG. 7 is a somewhat simplified flow diagram showing a method of estimating the masking threshold according to one embodiment of the present disclosure.

The calculation of masking threshold follows the steps generally illustrated by method 700 in FIG. 7. The embodiment of method 700 shown in FIG. 7 is for illustration only. Other embodiments of method 700 may be used without departing from the scope of this disclosure. Method 700 for efficiency reasons, in one embodiment, the present disclosure could use MDCT spectrum for the analysis.

The calculation is performed directly in scale factor band domain instead of partition domain (⅓rd bark). A simple triangle spreading function is used with +25 dB per bark and −10 dB per bark slope. The tonality index is computed using Spectral Flatness Measure instead of unpredictability.

Bit Allocation-Quantization Module

Bit allocation and quantization module 106 shown in FIG. 1 generally provides in MP3 a non-uniform quantizer as shown by the relationship in Equation 6 below:

$$\text{x_quantized}(i) = \text{int}\left[\frac{x^{3/4}}{2^{\frac{3}{16}(gl-scf(i))}} + 0.0946\right] \quad \text{(Eqn. 6)}$$

In Equation 6, i is the scale factor band index, x is the spectral values within that band to be quantized, gl is the global gain (the rate controlling parameter), and scf(i) is the scale factor value (the distortion controlling parameter). During inner loop iteration 204 or method 300, method 700 finds the appropriate global gain by conducting the adjustment incrementally. After this first calculation, the gradient relating the global gain change and bit rate change is established. The second onwards adjustment uses this gradient to adjust the global gain proportionally in order to reach the desired bit rate.

The gradient itself is adjusted every time iteration is performed. The change of global gain is restricted into multiples of four in order to reduce the complexity of the requantization calculation as explained earlier. Lastly, when computing resources are scarce, a limit in the number of inner loop iterations may be set. When this limit is reached, a bail out method is carried out to derive the global gain based on the number of bits available.

Table 1 below generally illustrates the list of Huffman Codebook available in MP3 encoding schemes. Table 1 is shown for illustration only. Other embodiments of Table 1 may be used without departing from the scope of this disclosure.

Table 1 also generally illustrates the largest absolute value each codebook can represent and the maximum number of bits used. Note that the "maximum_bit_used" shown here is for the encoding of spectral pairs.

TABLE 1

Huffman Codebook used in MP3 encoder

| Huffman Codebook number | LAV | maximum bit used |
|---|---|---|
| 0 | 0 | 0 |
| 1 | 1 | 3 |
| 2 | 2 | 6 |
| 3 | 2 | 6 |
| 4 | N/A | N/A |
| 5 | 3 | 8 |
| 6 | 3 | 7 |
| 7 | 5 | 10 |
| 8 | 5 | 11 |
| 9 | 5 | 9 |
| 10 | 7 | 11 |
| 11 | 7 | 11 |
| 12 | 7 | 10 |
| 13 | 15 | 19 |
| 14 | N/A | N/A |
| 15 | 15 | 13 |
| 16 | 16 | 19 |
| 17 | 18 | 21 |
| 18 | 22 | 23 |
| 19 | 30 | 25 |

TABLE 1-continued

Huffman Codebook used in MP3 encoder

| Huffman Codebook number | LAV | maximum bit used |
|---|---|---|
| 20 | 78 | 29 |
| 21 | 270 | 33 |
| 22 | 1038 | 37 |
| 23 | 8206 | 43 |
| 24 | 30 | 20 |
| 25 | 46 | 22 |
| 26 | 78 | 24 |
| 27 | 142 | 26 |
| 28 | 270 | 28 |
| 29 | 526 | 30 |
| 30 | 2062 | 34 |
| 31 | 8206 | 38 |

When a bail out method in accordance with one embodiment of the present disclosure is executed, the number of bits allocated per spectral pair is calculated based on the bit budget and the number of spectral pair to be coded as shown by the relationship exemplified by Equation 7 below.

$$\text{Desired_bit_used_per_spectral_pair} = \frac{\text{bit_budget} - (\text{si_bits} + region0\text{_count} + region1\text{_count})}{\text{number_of_spectral_pair}} \quad \text{(Eqn. 7)}$$

The bit budget has to take into account the number of bits needed for side information (si_bits), region0 and region1. From the 'desired_bit_used_per_spectral_pair' calculated, the desired_LAV is found based on Table 1.

With this desired_LAV, the quantization step size can be calculated using Equation 4, and the global gain value can be derived. With this value, even if all the spectral pair use the maximum_bit_used (which is unlikely the case), the total bit used to encode the frame would still be below the bit budget. Therefore, an exit from the inner loop is guaranteed.

Accordingly, in one embodiment, the present disclosure provides a fast and efficient method to estimate the global gain, which is a rate controlling parameter in a perceptual audio encoder. Using a gradient-based adjustment, the desired global gain may be obtained using the least number of iterations. With careful selection of the adjustment value, further computational reduction may be achieved. When there is a limit in the amount of computing resources available, a bail out method is also provided to derive the quantization parameter which guarantees an exit from the rate control loop.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method of bit allocation performed in an audio encoder, the method comprising:

in a quantization module of the audio encoder, incrementally adjusting a global gain by an incremental adjustment value according to a gradient until the incremental adjustment value reaches a predetermined incremental adjustment amount, wherein the gradient is adjusted each time a number of bits used to represent a quantized value is counted.

2. The method of claim 1 further comprising:

correlating changes in the gradient and the global gain with the number of bits used.

3. The method of claim 1 further comprising:

adjusting the gradient within one time frame.

4. The method of claim 1, wherein the gradient modifies a value of the global gain by a factor of four.

5. The method of claim 1 further comprising:

correlating adjustments to the gradient with the quantized value.

6. The method of claim 5 further comprising:

obtaining the quantized value using a scaling factor and a shift operation.

7. The method of claim 6 further comprising:

obtaining the scaling factor using at least one of: a lookup table and a bit shift.

8. The method of claim 1 further comprising:

deriving the global gain based on an available bit budget.

9. A method of bit allocation performed in a perceptual audio coder, the method comprising:

in a quantization module of the perceptual audio encoder, incrementally adjusting a global gain by an incremental adjustment value according to a gradient until the incremental adjustment value meets a predetermined termination criterion;

in the quantization module, adjusting the gradient according to a number of bits used to represent a quantized value; and limiting incremental adjustment of the global gain to a predetermined number of iterations.

10. The method of claim 8 further comprising:

adjusting the gradient within one time frame.

11. The method of claim 9, wherein the gradient modifies a value of the global gain by a factor of four.

12. The method of claim 9 further comprising:

correlating adjustments to the gradient and the global gain with the number of bits used to represent the quantized value.

13. The method of claim 12 further comprising:

obtaining the quantized value using a scaling factor and a shift operation.

14. The method of claim 13 further comprising:

obtaining the scaling factor using at least one of: a lookup table and a bit shift.

15. The method of claim 9, further comprising:

if the predetermined termination criterion is not met after the predetermined number of iterations, deriving the global gain based on an available bit budget.

16. The method of claim 15, further comprising:

deriving the global gain based on a largest absolute value of a worst case Huffman codebook.

17. A perceptual audio encoder comprising:

an audio input; and a quantization module coupled to the audio input, the quantization module configured to:

incrementally adjust a global gain by an incremental adjustment value according to a gradient until the incremental adjustment value reaches a predetermined incremental adjustment amount; and adjust the gradient each time a number of bits used to represent a quantized value is counted.

18. The perceptual audio encoder of claim 17, wherein the quantization module is further configured to limit incremental adjustment of the global gain to a predetermined number of iterations.

19. The perceptual audio encoder of claim 18, wherein the quantization module is further configured to derive the global gain from an available bit budget if the specified incremental adjustment amount is not reached after the predetermined number of iterations.

20. The perceptual audio encoder of claim 18, wherein the quantization module is further configured to derive the global gain from a largest absolute value of a worst case Huffman codebook.

21. The perceptual audio encoder of claim 17, wherein the quantization module is further configured to correlate changes in the gradient and the global gain with the number of bits used.

22. The perceptual audio encoder of claim 17, wherein the gradient modifies a value of the global gain by a factor of four.

23. The perceptual audio encoder of claim 17, wherein the quantization module is further adapted to correlate adjustments to the gradient with the quantized value.

* * * * *